US005121168A

United States Patent [19]

Aoki et al.

[11] Patent Number: 5,121,168

[45] Date of Patent: Jun. 9, 1992

[54] IMAGE FORMING APPARATUS HAVING A USED TONER STORAGE PORTION

[75] Inventors: Hideo Aoki, Yokohama; Toshiro Sahashi, Atsugi, both of Japan

[73] Assignee: Ricoh Company, Ltd., Tokyo, Japan

[21] Appl. No.: 640,908

[22] Filed: Jan. 14, 1991

[30] Foreign Application Priority Data

Jan. 19, 1990 [JP] Japan ..... 2-3795[U]

[51] Int. Cl.[5] ..... G03G 21/00

[52] U.S. Cl. ..... 355/298; 118/652

[58] Field of Search ..... 355/296, 298, 299, 260, 355/245; 118/652

[56] References Cited

U.S. PATENT DOCUMENTS

| | | | |
|---|---|---|---|
| Re. 33,484 | 12/1990 | Imanaka | 355/298 |
| 3,998,537 | 12/1976 | Smith et al. | 355/260 |
| 4,724,459 | 2/1988 | Ford | 118/652 X |
| 4,768,055 | 8/1988 | Takamatsu et al. | 355/298 |
| 4,894,688 | 1/1990 | Taniguchi et al. | 355/298 |
| 5,017,962 | 5/1991 | Tsuji et al. | 355/260 X |

FOREIGN PATENT DOCUMENTS

| | | | |
|---|---|---|---|
| 0157774 | 12/1980 | Japan | 355/298 |

*Primary Examiner*—A. T. Grimley
*Assistant Examiner*—William J. Royer
*Attorney, Agent, or Firm*—Oblon, Spivak, McClelland, Maier & Neustadt

[57] ABSTRACT

In an image forming apparatus, a latent image on a photosensitive body is developed by a developing device and is transferred onto a sheet of paper and remaining toner on the photosensitive body is removed therefrom by a cleaner. The image forming apparatus has a used toner storing portion for collecting the removed remaining toner thereinto and integral with the developing container; a conveyor for conveying the removed remaining toner to the used toner storing portion; and a driving force transmitting device for connecting the conveyor to a rotary shaft of an agitator disposed in the developing device so as to transmit driving force therebetween. When the developing device is replaced by a new one, the used toner storing portion integral with this developing device is also replaced by a new one. The conveyor may have an auger and the driving force transmitting device may have pulleys for the agitator and the auger.

7 Claims, 4 Drawing Sheets

IMAGE FORMING APPARATUS HAVING A USED TONER STORAGE PORTION

BACKGROUND OF THE INVENTION

1. Field of the Invention

The present invention relates to an image forming apparatus such as an electrophotographic device composed of a printer, a copying machine, a facsimile, etc. using a laser and recording image on a sheet of paper by using an electrophotographic processing. More particularly, the present invention relates to a developing device for attaching toner onto a photosensitive body to visualize a latent image on the photosensitive body in such an image forming apparatus.

2. Description of the Related Art

In a general image forming apparatus, a used toner storing portion is integrally disposed with a cleaner. In such an image forming apparatus, after a toner image is transferred onto a sheet of paper, remaining toner left on a photosensitive body is removed therefrom by the cleaner and is collected into the used toner storing portion. In the image forming apparatus of this kind, the used toner storing portion is replaced by a new one together with the cleaner.

In this image forming apparatus, a used toner bottle is connected to the cleaner through a conveying means such that the remaining toner removed from the photosensitive body by the cleaner is conveyed by the conveying means and is collected into the used toner bottle. In such a structure, when the used toner bottle is filled with the remaining toner, this used toner bottle is replaced by a new one.

However, such a structure has the following problems.

(1) It is necessary to dispose a mechanism for detecting a filling state of the used toner storing portion or the used toner bottle.

(2) When the used toner storing portion is integrally disposed with the cleaner, the size of the used toner storing portion is reduced since a space for attaching the used toner storing portion to the cleaner is small. Therefore, it is necessary to often replace the used toner storing portion by a new one so that it is troublesome for a user to perform such a replacing operation.

(3) When the used toner is collected into the used toner bottle, it is troublesome for the user to dispose of the used toner bottle detached from the image forming apparatus.

SUMMARY OF THE INVENTION

It is therefore an object of the present invention to provide an image forming apparatus in which it is not necessary to dispose a mechanism for detecting a filling state of toner in a used toner storing portion and it is not necessary to often replace the used toner storing portion by a new one and dispose a used toner bottle causing a problem in disposal.

The above object of the present invention can be achieved by an image forming apparatus in which a latent image on a photosensitive body is developed by a developing device and is transferred onto a sheet of paper and remaining toner on the photosensitive body is removed therefrom by a cleaner, the image forming apparatus comprising a used toner storing portion for collecting the removed remaining toner thereinto and integral with the developing container; conveying means for conveying the removed remaining toner to the used toner storing portion; and driving force transmitting means for connecting the conveying means to a rotary shaft of an agitator disposed in the developing device so as to transmit driving force therebetween.

In the above structure, rotational force of the rotary shaft of the agitator is transmitted to the conveying means through the driving force transmitting means. Thus, the conveying means is operated to convey the remaining toner removed from the photosensitive body by the cleaner to the used toner storing portion. When the developing device is replaced by a new one, the used toner storing portion integral with this developing device is also replaced by a new one.

In accordance with the above structure, it is not necessary to dispose a mechanism for detecting a filling state of toner in the used toner storing portion and it is not necessary to often replace the used toner storing portion by a new one and dispose a used toner bottle causing a problem in disposal.

Further objects and advantages of the present invention will be apparent from the following description of the preferred embodiments of the present invention as illustrated in the accompanying drawings.

DESCRIPTION OF THE PREFERRED EMBODIMENTS

The preferred embodiment of an image forming apparatus in the present invention will next be described in detail with reference to the accompanying drawings.

Figure 1:
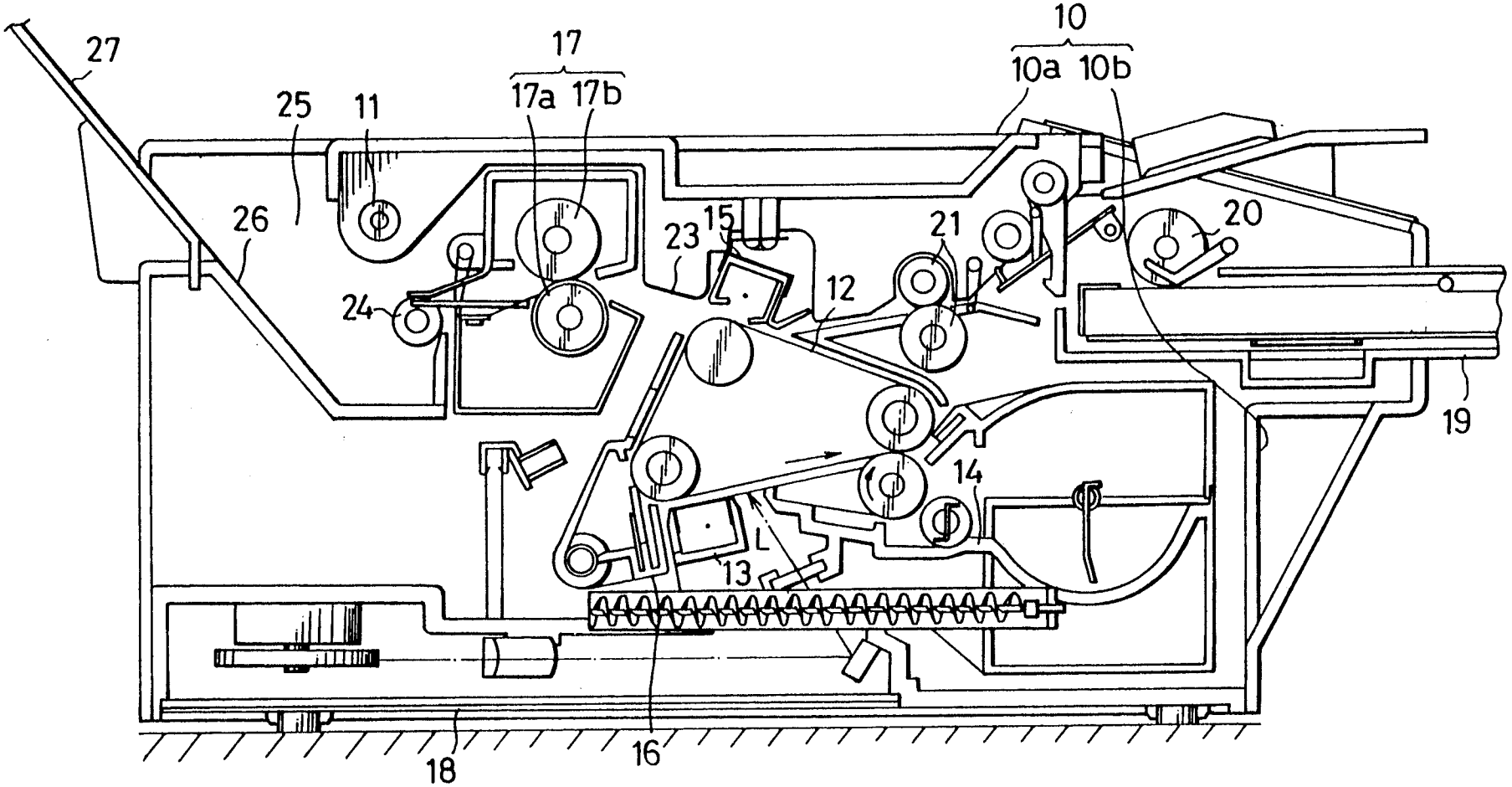
FIG. 1 is a schematic view showing the entire construction of an internal mechanism in a laser printer as an image forming apparatus provided with a developing device in one embodiment of the present invention.

FIG. 1 is a schematic view showing the entire construction of an internal mechanism in a laser printer as an image forming apparatus provided with a developing device in one embodiment of the present invention. In FIG. 1, a body 10 of the image forming apparatus is constructed by an upper structure 10*a* and a lower structure 10*b*. The upper structure 10*a* is attached to the lower structure 10*b* by a shaft 11 such that the upper structure 10*a* can be freely opened and closed with respect to the lower structure 10*b*. A photosensitive body 12 formed in the shape of a belt is approximately disposed in a central portion of the apparatus body 10. A charger 13, a developing container 14, a transfer device 15 and a cleaner 16 are sequentially arranged around the photosensitive body 12 in a rotational direction shown by an arrow in FIG. 1. An optical writing device 18 is arranged on lower sides of the charger 13 and the cleaner 16. A paper supplying cassette 19 is arranged on a slanting upper side of the developing container 14.

A sheet of paper is fed from the paper supplying cassette 19 by a paper feed roller 20 and is conveyed onto the photosensitive body 12 by a pair of resist rollers 21 at a predetermined timing. The photosensitive body 12 is rotated in the counterclockwise direction as shown by the arrow in FIG. 1. At this time, a surface of the photosensitive body 12 is uniformly charged by the charger 13. Further, a laser beam L is irradiated onto this surface of the photosensitive body 12 from the optical writing device 18 so as to form an electrostatic latent image on the photosensitive body 12. This latent image is visualized by toner when this latent image passes through the developing container 14. This visualized image is transferred by the transfer device 15 onto a lower face of the sheet of paper conveyed onto the photosensitive body 12. The transferred sheet of paper is guided by a conveying guide 23 and is then conveyed between a fixing roller 17*a* and a pressurizing roller 17*b* constituting a fixing device 17 so as to fix the visualized image onto the sheet of paper. This sheet of paper discharged from the fixing device 17 is further conveyed to a paper discharging section 25 by a paper discharging roller 24. The conveyed sheet of paper is guided by a paper discharging guide 26 and is then stacked onto a paper discharging tray 27. After the visualized image has been transferred onto the sheet of paper, remaining toner on the photosensitive body 12 is removed therefrom by the cleaner 16.

Figure 2:
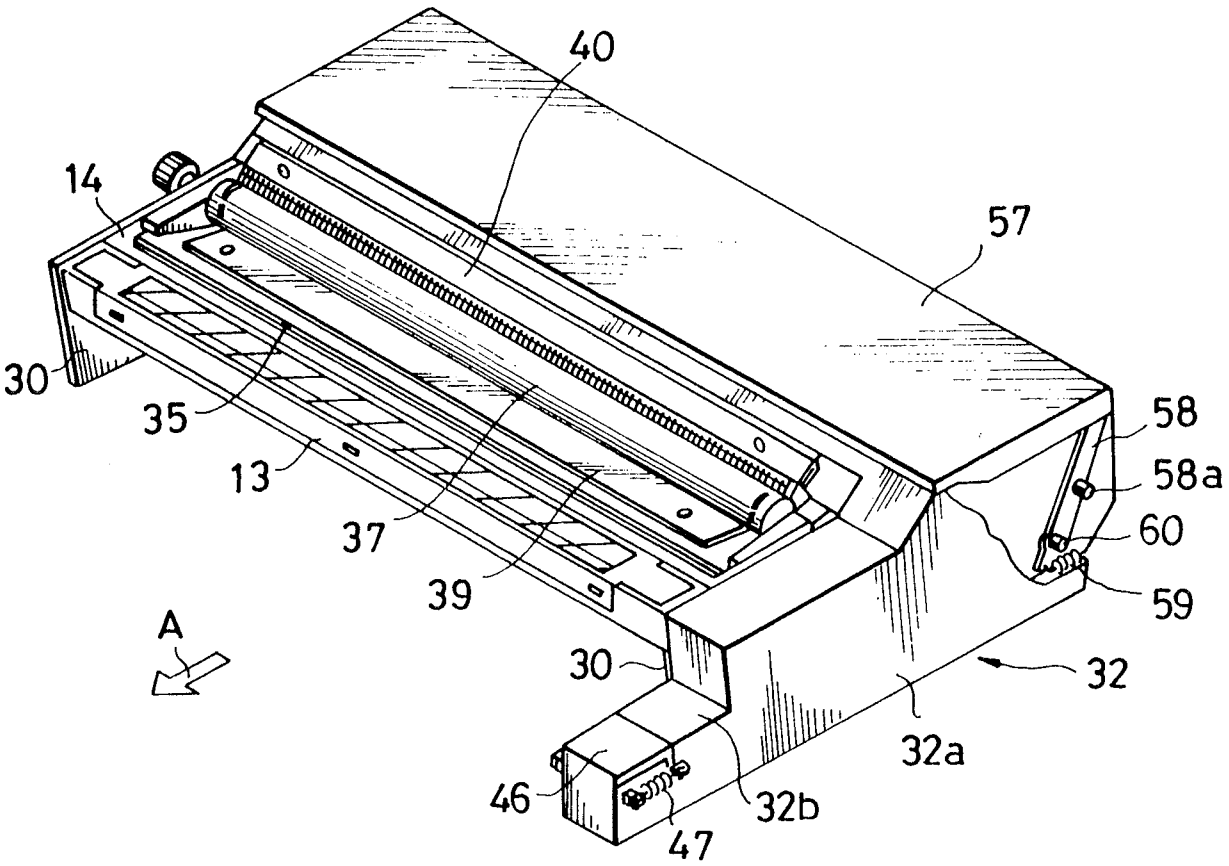
FIG. 2 is a perspective view of the developing device in the image forming apparatus of the present invention.
Figure 3:
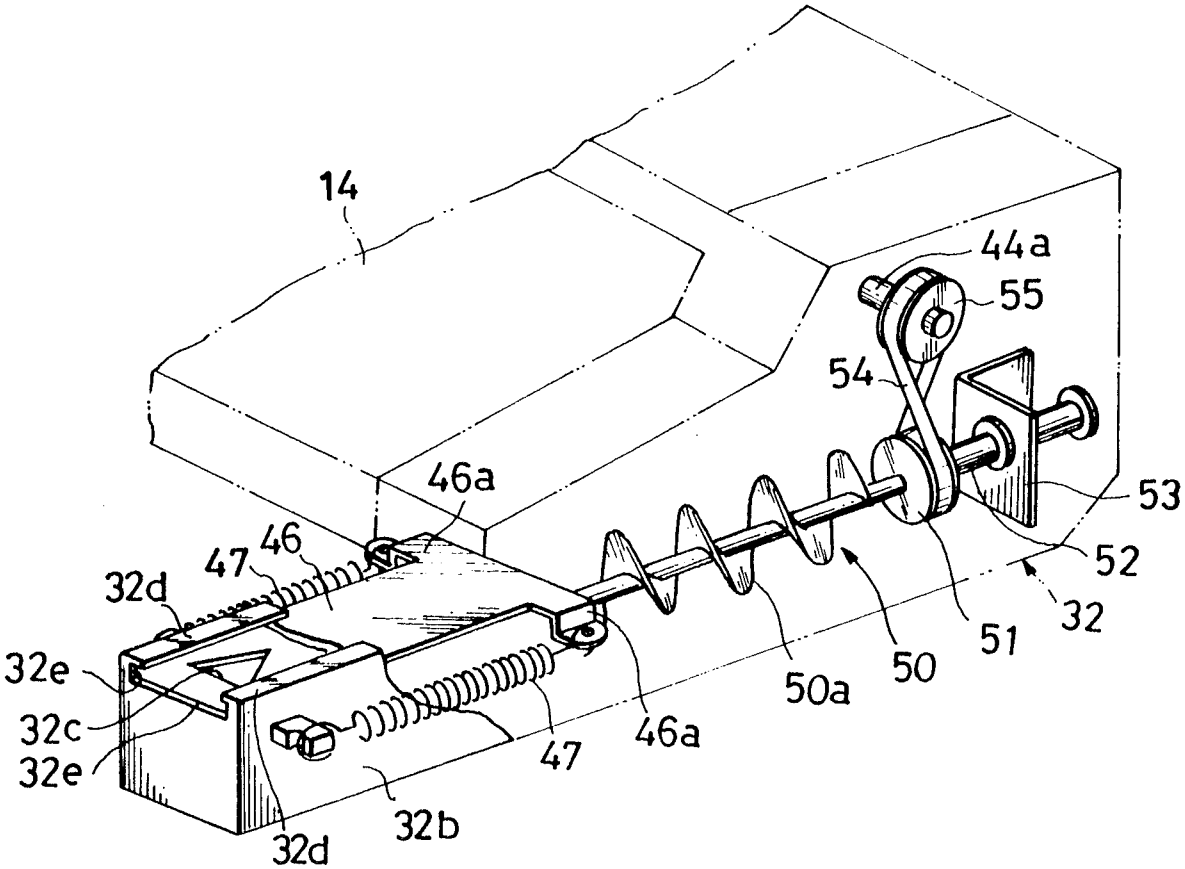
FIG. 3 is a schematic view showing the construction of a used toner storing portion disposed in the developing device shown in FIG. 2.
Figure 4:
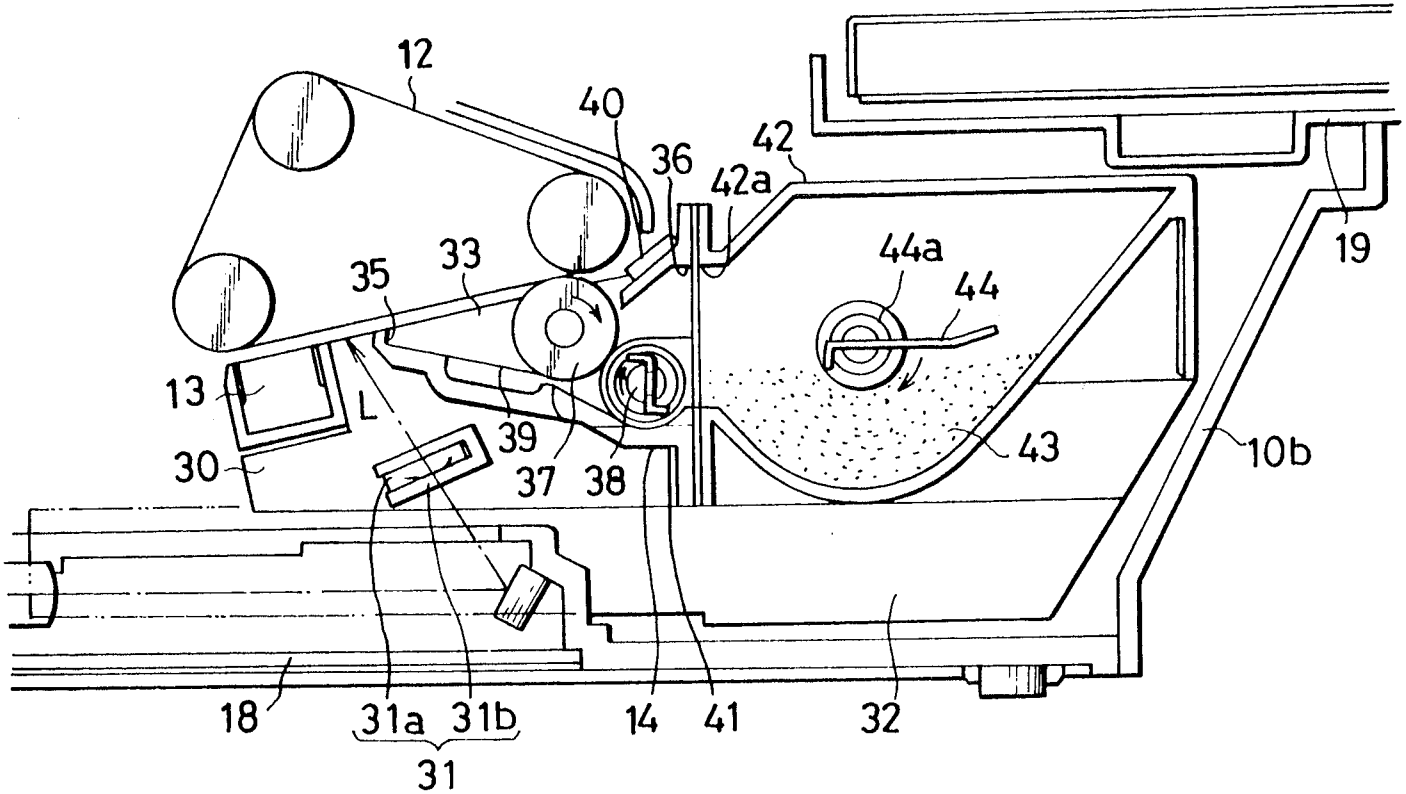
FIG. 4 is a schematic view showing the construction of a peripheral portion around the developing device in the laser printer provided with the developing device shown in FIG. 2.

The developing device in the present invention has a pair of developing frames 30 opposed to both sides of a paper conveying direction A shown by an arrow in FIG. 2. As shown in FIG. 4, the charger 13, an optical part 31, the developing container 14 and a used toner storing portion 32 are integrally supported by the developing frames 30, thereby constituting a unit. This unit is detachably attached into the lower structure 10*b* of the apparatus body 10. The optical part 31 transmits the laser beam L therethrough from the optical writing device 18 and is constituted by a second CY lens 31*a* and an engaging portion 31*b*. Both ends of the second CY lens 31*a* in a longitudinal direction thereof are supported by the engaging portion 31*b* so that the second CY lens 31*a* is arranged on an optical path of the laser beam L. The engaging portion 31*b* has a U-shape in cross section and is projected inward from an inner face of the developing frames 30. The developing container 14 is constructed by a body 41 thereof and a toner cartridge 42. The developing container body 41 has a developing room 33 therein and a roller window 35 opened on a side of the photosensitive body 12. The developing container body 41 also has a toner supplementary port 36 opened on a side thereof opposite to the photosensitive body 12. A developing roller 37, a toner supplementary roller 38, a thin layer blade 39 and a discharging brush 40 are respectively disposed within the developing room 33. An end of the thin layer blade 39 is pressed against the developing roller 37 and an end of the discharging brush 40 comes in contact with the developing roller 37 (see FIG. 4). The developing roller 37 is pressed against the photosensitive body 12 through the roller window 35. The toner cartridge 42 is integrally connected by a thermal fixing method, etc. onto a side of the toner supplementary port 36 of the developing container body 41 such that an opening 42*a* and the toner supplementary port 36 are adjacent and face each other. The toner cartridge 42 stores toner 43 therein and rotatably supports an agitator 44 around a rotary shaft 44*a* thereof. As shown in FIG. 2, the used toner storing portion 32 is arranged on a side of one of the developing frames 30. A body casing 32*a* of the used toner storing portion 32 has a hollow box shape extending in the paper conveying direction. A front portion 32*b* of the used toner storing portion 32 is projected forward from the charger 13. An upper side of the body casing 32*a* is formed in the shape of stairs such that the front portion 32*b* is lowest. As shown in FIG. 3, a used toner inlet 32*c* is opened on an upper side of the front portion 32*b* and rising guides 32*d* are disposed on both sides of this used toner inlet 32*c* such that guide grooves 32*e* are formed to be opposed to each other. Both sides of a shutter 46 are fitted into the guide grooves 32*e* so as to slidably move the shutter 46. One end of a tension spring 47 is engaged with an engaging portion 46*a* of the shutter 46. The other end of the tension spring 47 is engaged with the front portion 32*b*. The tension spring 47 normally biases the shutter 46 in a direction in which the used toner inlet 32*c* is closed. A conveying means 50 for conveying the remaining toner removed from the photosensitive body 12 by the cleaner 16 is disposed within the body casing 32*a* of the used toner storing portion 32. This conveying means 50 is constructed by a spiral auger 50*a* rotatably connected to an auger pulley 51 at a rear end thereof. The auger pulley 51 is fixed to a rotary shaft 52 thereof supported by a bracket bearing 53. A front end of the auger 50*a* is arranged in the vicinity of the used toner inlet 32*c*. A belt 54 is wound around the auger pulley 51 and is further wound around an agitator pulley 55. The agitator pulley 55 is fixed to the rotary shaft 44*a* of the agitator 44 projected into the body casing 32*a* of the used toner storing portion 32.

As shown in FIG. 4, when the developing device shown in FIG. 2 is attached into the lower structure 10*b* of the apparatus body 10, the engaging portion 46*a* of the shutter 46 hits against an unillustrated stopper within the lower structure 10*b*. Accordingly, as shown in FIG. 3, the shutter 46 is moved and opened against resilient force of the tension spring 47, thereby opening the used toner inlet 32*c*. An unillustrated used toner outlet of the cleaner 16 is then connected to the used toner inlet 32*c*. In FIG. 4, when the agitator 44 is rotated in the clockwise direction shown by an arrow, toner 43 is supplemented to the developing room 33 while the toner 43 is agitated by the agitator 44 in this clockwise direction. The developing roller 37 is rotated in the clockwise direction shown by an arrow in FIG. 4 so that the toner supplementary roller 38 is also rotated in the clockwise direction. Thus, the toner 43 is frictionally charged and is attached onto the developing roller 37. The attached toner 43 is formed in the shape of a thin layer by the thin layer blade 39. This thin layer toner is then attached onto the photosensitive body 12 to visualize the latent image on a surface thereof.

As shown in FIG. 3, when the agitator 44 is rotated, rotational force of the rotary shaft 44*a* of the agitator 44 is transmitted to the auger 50*a* through the agitator pulley 55, the belt 54 and a means for transmitting driving force of the auger pulley 51, thereby rotating the auger 50*a*. In this case, power required to rotate the auger 50*a* in the used toner storing portion 32 is increased as power required to rotate the agitator 44 of the toner cartridge 42 is decreased. Accordingly, a total amount of the powers required to rotate the auger 50*a* and the agitator 44 is approximately constant irrespective of an amount of the used toner. The remaining toner supplied from the used toner inlet 32*c* is sequentially conveyed by the rotation of the auger 50*a* to an internal deep portion of the used toner storing portion 32. Thereafter, when there is no toner left in the developing container 14 and the developing container 14 is replaced by a new one, the used toner storing portion 32 integral with the developing container 14 is also replaced by a new one.

In FIG. 2, a cover plate 57 widely covers the roller window 35, the charger 13 and the optical part 31. When the developing device is attached into the apparatus body 10, an engaging pin 58*a* of a link portion 58 joined to the cover plate 57 hits against an unillustrated stopper. Then, the link portion 58 is rotated in the clockwise direction around a support shaft 60 against the resilient force of a tension spring 59 while the developing device is inserted into the apparatus body, thereby opening the cover plate 57 as shown in FIG. 2.

In the above embodiment, the driving force transmitting means is constructed such that the belt 54 is wound around the agitator pulley 55 and the auger pulley 51 to transmit the rotational force of the rotary shaft 44*a* of the agitator 44 to the auger 50*a*. However, in the present invention, the driving force transmitting means may be constructed by gears for transmitting the rotational force of the rotary shaft of the agitator 44 to the auger 50*a*.

As mentioned above, in accordance with the present invention, the following effects can be obtained.

(1) The developing container and the used toner storing portion can be simultaneously replaced by new ones so that it is not necessary to separately replace the used toner storing portion by a new one.

(2) The size of the used toner storing portion can be increased so that it is not necessary to often replace the used toner storing portion by a new one.

(3) Since the used toner storing portion can be replaced by a new one together with the developing container, it is not necessary to dispose a mechanism for detecting a filling state of toner within the used toner storing portion, thereby reducing the cost of the image forming apparatus.

(4) Since the used toner storing portion can be replaced by a new one together with the developing container, it is not necessary to dispose of a detached used toner bottle as in the general image forming apparatus.

(5) The rotational force of a rotary shaft of the agitator is transmitted to the conveying means through the driving force transmitting means so that no changes in torque and rotation of a developing roller are caused and no irregular development is caused.

Many widely different embodiments of the present invention may be constructed without departing from the spirit and scope of the present invention. It should be understood that the present invention is not limited to the specific embodiments described in the specification, except as defined in the appended claims.

What is claimed is:

1. An image forming apparatus in which a latent image on a photosensitive body is developed by a developing device and is transferred onto a sheet of paper and remaining toner on the photosensitive body is removed therefrom by a cleaner, said image forming apparatus comprising:

a used toner storing portion for collecting the removed remaining toner thereinto and integral with said developing device;

conveying means for conveying the removed remaining toner to the used toner storing portion; and driving force transmitting means contained in the used toner storing portion and connecting the conveying means to a rotary shaft of an agitator disposed in said developing device for transmitting a driving force therebetween, said rotary shaft being adapted to rotate independently of a developing roller of the developing device.

2. An image forming apparatus as claimed in claim 1, wherein, when the developing device is replaced by a new one, the used toner storing portion integral with this developing device is also replaced by a new one.

3. An image forming apparatus as claimed in claim 1, wherein the conveying means comprises an auger.

4. An image forming apparatus as claimed in claim 3, wherein the driving force transmitting means comprises pulleys for the agitator and the auger.

5. An image forming apparatus as claimed in claim 1, wherein the used toner storing portion is arranged on a side of one of developing frames of the developing device.

6. An image forming apparatus as claimed in claim 5, wherein the used toner storing portion extends in a direction in which the sheet of paper is conveyed.

7. An image forming apparatus as claimed in claim 6, wherein the conveying means is disposed within the used toner storing portion and extends in the direction in which the sheet of paper is conveyed.

* * * * *